US006802692B2

(12) United States Patent
Bouru

(10) Patent No.: US 6,802,692 B2
(45) Date of Patent: Oct. 12, 2004

(54) DEVICE FOR CONTROLLING A VARIABLE-ANGLE VANE VIA A PINCH CONNECTION

(75) Inventor: Michel Bouru, Montereau sur le Jard (FR)

(73) Assignee: SNECMA Moteurs, Paris (FR)

( * ) Notice: Subject to any disclaimer, the term of this patent is extended or adjusted under 35 U.S.C. 154(b) by 78 days.

(21) Appl. No.: 10/352,127

(22) Filed: Jan. 28, 2003

(65) Prior Publication Data

US 2003/0143067 A1 Jul. 31, 2003

(30) Foreign Application Priority Data

Jan. 29, 2002 (FR) ..... 02 01023

(51) Int. Cl.[7] ..... F01D 17/16; F01B 25/02

(52) U.S. Cl. ..... 415/160; 403/286; 403/291; 403/61; 403/73

(58) Field of Search ..... 415/229, 159, 415/160, 161, 162, 403, 286, 291, 292, 239, 52, 61, 65, 73

(56) References Cited

U.S. PATENT DOCUMENTS 3,030,072 A * 4/1962 Boyd ..... 415/163
4,299,534 A * 11/1981 Yamane et al. ..... 415/165
5,024,580 A 6/1991 Olive
5,407,322 A 4/1995 Charbonnel et al.
6,688,846 B2 * 2/2004 Caubet et al. ..... 415/160

FOREIGN PATENT DOCUMENTS

| | | | |
|---|---|---|---|
| EP | 1 010 862 A2 | 6/2000 | |
| FR | 2 608 678 | 6/1988 | |
| FR | 2 746 141 | 9/1997 | |
| JP | 355114883 A * | 9/1980 | ..... F03B/3/18 |

* cited by examiner

*Primary Examiner*—Edward K. Look
*Assistant Examiner*—Igor Kershteyn
(74) *Attorney, Agent, or Firm*—Oblon, Spivak, McClelland, Maier & Neustadt, P.C.

(57) ABSTRACT

A device for controlling a variable-angle vane for a stator of a turbomachine compressor, the device comprising a link, connection means forming a hinge between a first end of the link and a control ring, fixing means for fixing a second end of the link on a pivot of a vane to be controlled, and pinch means acting transversely relative to a longitudinal midplane of the link to lock the second end of the link in rotation without slack on the pivot.

18 Claims, 5 Drawing Sheets

DEVICE FOR CONTROLLING A VARIABLE-ANGLE VANE VIA A PINCH CONNECTION

BACKGROUND OF THE INVENTION

The present invention relates to controlling vanes having a variable setting angle. A particular application for the invention lies in the field of aviation, in particular for controlling the angular positions of air inlet guide vanes in the compressors of turbomachines, such as airplane turbomachines.

Known devices for controlling variable-setting vanes in a turbomachine generally comprise a control member in the form of a ring surrounding the casing of the turbomachine and a plurality of levers or links, each link having a first end connected to the control ring via a hinge and a second end mounted on the pivot of a respective vane.

The angular position of the vanes is changed synchronously by turning the ring about the axis of the turbomachine. In order to be able to follow the turning movement of the ring, the connection between each link and the ring has at least one degree of freedom in rotation about an axis extending substantially radially relative to the ring. Nevertheless, since the link is rigidly mounted to the pivot of the corresponding vane, turning the ring induces other relative movements between the ring and the portion of the link mounted on the vane pivot. In order to accommodate these additional movements, or at least some of them, it is known to make the connection in the form of a ball-and-socket joint or an analogous part which, in addition to turning about an axis that is substantially radial relative to the ring, also allows turning to take place about an axis that is substantially circumferential in direction relative to the ring. Proposals have also been made for a connection that offers an additional degree of freedom in translation in a direction that is substantially radial relative to the ring. Reference can be made to documents FR-A-2 608 678 or FR-A-2 746 141, amongst others.

U.S. Pat. No. 6,019,574 discloses a mechanical hinge between the vane pivot and the end of the link mounted thereon by means of a tenon-and-mortise system: the vane pivot has a threaded end passing through an orifice pierced through the control link. A nut tightened onto the threaded end of the pivot enables this assembly of parts to turn together. Similarly, in European patent application EP 1 010 862 a hinge is described that is obtained by drive studs secured to the vane pivot and penetrating into slots formed at the end of the link mounted on the pivot. That assembly is likewise caused to rotate as a whole by means of a nut screwed onto a threaded end of the vane pivot.

Nevertheless, in those documents, the precision with which the control link turns relatively to the vane pivot leaves an error in the range 0.4° to 0.6° in common practice. This low level of precision stems from the fact that clearance exists between the various parts due to the assembly tolerances of the control device. Slack occurs in particular between the pivot and the end of the link mounted thereon. This gives rise to lack of precision in turning the link which is particularly harmful to proper operation of the assembly.

OBJECT AND SUMMARY OF THE INVENTION

The present invention thus seeks to mitigate such drawbacks by proposing a control device using fixing means for the link which enable it to be held without slack on the vane pivot. Another object of the invention is to eliminate lack of precision in turning.

To this end, the invention provides a device for controlling a variable-angle vane for a stator of a turbomachine compressor, the device comprising a link, connection means forming a hinge between a first end of the link and a control ring, and fixing means for fixing a second end of the link on a pivot of a vane to be controlled, the device further comprising pinch means acting transversely relative to a longitudinal midplane of the link to lock the second end of the link in rotation without slack on the pivot.

As a result, any risk of slack between the vane pivot and the end of the link mounted thereon is eliminated. The precision with which the link turns the vane pivot is therefore improved.

The pinch means comprise a clamping cap applied to the second end of the link and subjected to an axial clamping force under the effect of the fixing means. The clamping cap has a radial passage which possesses at least one inside face which is inclined relative to a longitudinal midplane of said passage and which cooperates with a side face of the second end of the link to produce the pinching force.

The clamping cap may exert this pinching force directly on at least one corresponding inclined side face of the second end of the link, or else via contact elements that are interposed between at least one inclined inside face of the clamping cap and a corresponding side face of the second end of the link.

The contact elements may either be in the form of at least one flexible tongue projecting longitudinally from one side of a central block of the pivot, or else in the form of at least one piece of shim interposed between the clamping cap and a side face of the second end of the link.

The second end of the link may be of channel section with two flanges bearing against the side surfaces of a central block of the pivot.

In order to provide keying to avoid confusion between a leading edge and a trailing edge of the link, the positions of the side faces or of the flanges of the link may be asymmetrical about the midplane.

The fixing means may comprise a screw passing successively through a first orifice formed in the second end of the link, a second orifice formed in the clamping cap, and a third orifice formed in the vane pivot. In a variant, the fixing means may comprises a screw-and-nut system constituted by a threaded rod secured to the vane pivot having an axial clamping nut screwed thereon.

BRIEF DESCRIPTION OF THE DRAWINGS

Other characteristics and advantages of the present invention appear from the following description given with reference to the accompanying drawings which show various embodiments that do not have any limiting character. In the figures.

DETAILED DESCRIPTION OF SEVERAL EMBODIMENTS

Figure 1:
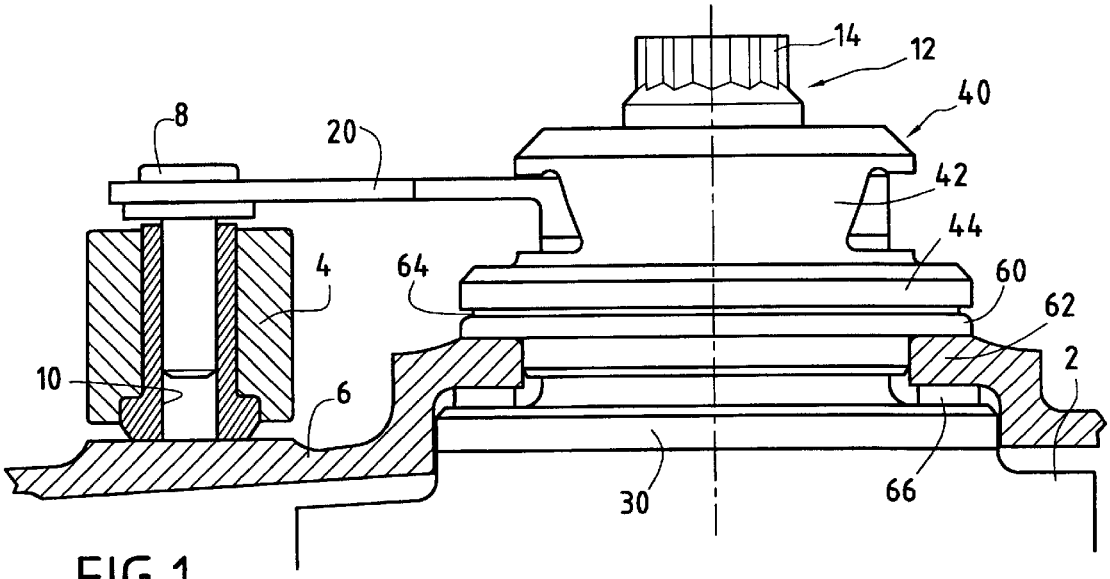
FIG. 1 is a view partially in longitudinal section of a first embodiment of a control device of the invention.

FIG. 1 shows a small portion of a turbomachine, e.g. an airplane turbojet, provided with vanes 2 of variable setting angle. By way of example, these vanes are guide vanes at the inlet to the compressor of the turbomachine, and they are distributed around the axis thereof. FIG. 1 shows only one vane.

In well-known manner, the angular position of the vanes 2 is controlled by means of a control ring 4 surrounding a casing 6 of the turbomachine (shown in part only in FIG. 1), and by means of a plurality of links 20. Each link 20 has a first end 20*a* connected to the control ring 4 via hinge-forming connection means. By way of example, the hinge is constituted by a pin or finger 8 passing through the first end 20*a* of the link 20 and engaged in a radial housing 10 of the control ring 4.

A second end 20*b* of the link 20 is mounted on a pivot 30 of the vane 2 via fixing means 12. These fixing means 12 conventionally comprise a separate screw 14 and a self-braking bushing (not shown) implanted in the vane pivot. If the radial extent of the vane pivot is too small to allow a self-braking bushing to be implanted, it is also possible to provide fixing means in the form of a screw-and-nut system (not shown) comprising a threaded rod secured to the vane pivot which has an axial clamping nut screwed thereon.

In the invention, pinch means are provided which act transversely relative to a longitudinal midplane P of the link to lock the second end 20*b* of the link 20 on the pivot of the vane to turn without slack. These pinch means comprise a clamping cap 40 pressed against the second end 20*b* of the link 20 and against the vane pivot by the fixing means 12. The end 20*b* of the link and the vane pivot 30 bear against each other transversely via side faces that are substantially parallel to the plane P. The cap 40 has at least one inside face that is inclined relative to the longitudinal midplane P of the link and which co-operates with a corresponding inclined face of the second end 20*b* of the link or of the pivot 30 or of a contact element interposed between the end portion 20*b* for the link and the pivot 30. Under the effect of the axial clamping of the cap 40, the inclined faces co-operate with one another to produce a pinch force extending transversely relative to the end 20*b* of the link on the vane pivot.

Several embodiments of the pinch means are described below.

Figure 2:
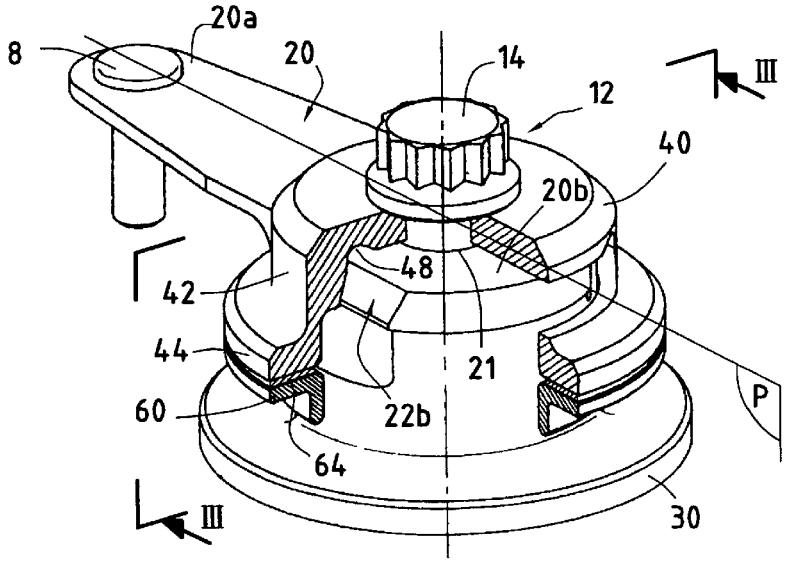
FIG. 2 is a cutaway perspective view of the FIG. 1 device.
Figure 3:
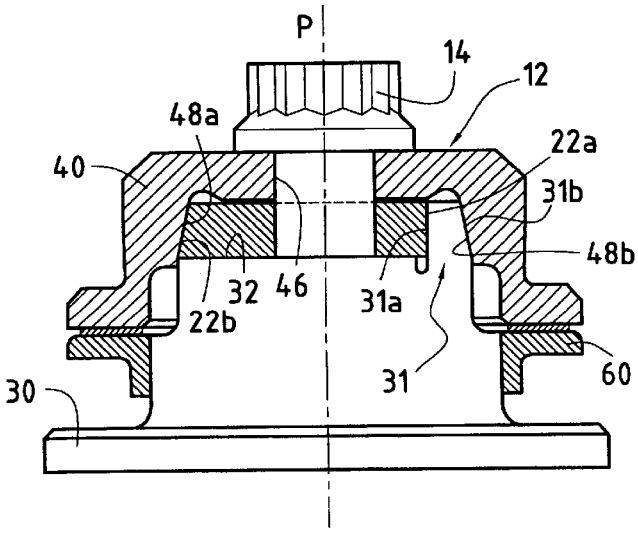
FIG. 3 is a section view on plane III—III of FIG. 2.

In a first embodiment of the invention as shown in FIGS. 2 and 3, the pivot 30 of the vane of the control device has a rigid side portion 31 projecting longitudinally from a top face 32 of the pivot 30 in the vicinity of the edge thereof. This rigid portion is made integrally with the pivot 30, it has a plane inside face 31*a* that is substantially parallel to the plane P and it has a plane outside face 31*b* which is inclined relative to the plane P. The plane inside face 31*a* of the rigid portion may also be slightly inclined relative to the plane P in order to hold the link 20 better on the pivot 30.

The second end 20*b* of the link 20 presents an orifice 21 in which there is engaged with clearance the screw 14 (or else a threaded rod secured to the vane pivot), and said end bears against the face 32 of the pivot 30. This end 20*b* of the link has a first side face 22*a* which is substantially parallel to the longitudinal midplane P of the link and which bears against the plane inside face 31*a* of the rigid portion 31, and it has a second side face 22*b* which is inclined relative to the plane P.

In the description below, when a surface is said to be inclined relative to the longitudinal midplane P of the link, that means that said surface makes an angle lying in the range 15° to 30°, for example, relative to the plane P.

The clamping cap 40 has a substantially cylindrical portion 42 extended at its bottom end by a collar 44. At its top end, the cap 40 presents an orifice 46 in which the screw 14 (or the threaded rod) is engaged. A transverse passage 48 is formed in the cylindrical portion 42 of the cap to receive the second end 20*b* of the link 20 and the rigid portion 31 of the pivot 30. The passage 48 lies between two inclined side faces 48*a* and 48*b* of inclinations that correspond to the inclinations of the faces 22*b* and 31*b*, and bearing thereagainst.

The screw 14 is inserted successively through the orifice 46 of the clamping cap, through the orifice 21 in the second end of the link, and into an orifice (not shown) formed axially in the vane pivot. If a screw-and-nut system is used, then the threaded rod secured to the vane pivot likewise passes through the orifice 21 in the second end of the link, and the orifice 46 in the clamping cap. Under the effect of axial clamping and the resulting bearing force on the inclined faces 22*b* and 31*b*, transverse pinching is exerted serving to press the faces 31*a* and 22*a* against each other, thus providing a connection without slack in rotation between the link 20 and the vane pivot 30.

In the example shown, the cap 40 is substantially symmetrical in shape, exerting a symmetrical pinching force with the two inclined side faces 48*a* and 48*b* on either side of the passage 48. In a variant, only the side face 48*a* need be inclined in order to co-operate with the face 22*b* at the second end 20*b* of the link, with the other face 48*b* being parallel to the plane P, in which case the face 31*b* should also be parallel thereto.

Figure 4:
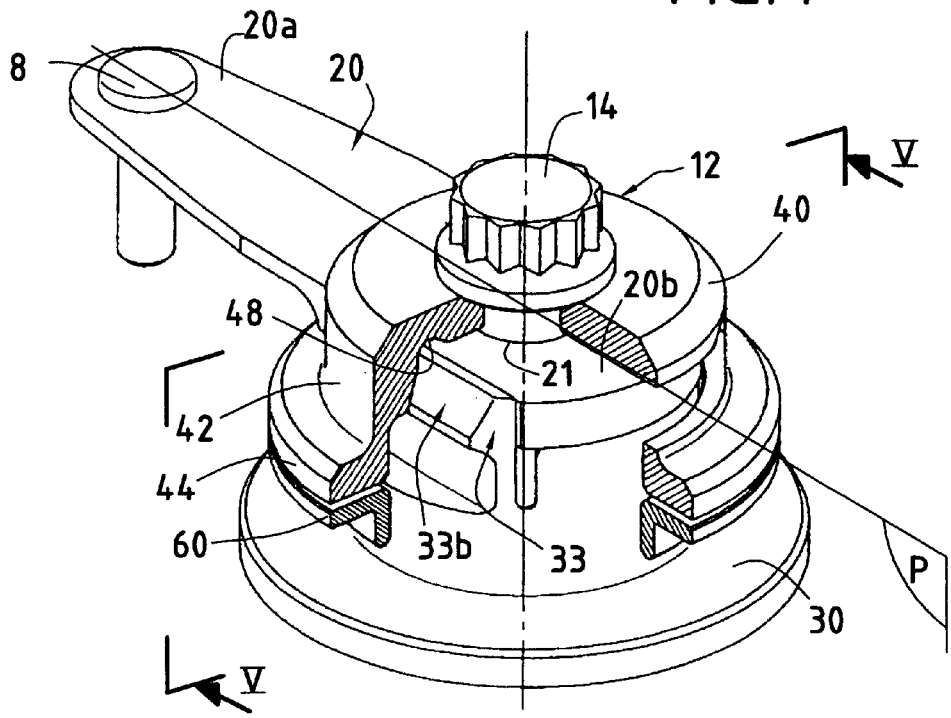
FIG. 4 is a cutaway perspective view of a control device constituting a second embodiment of the invention.
Figure 5:
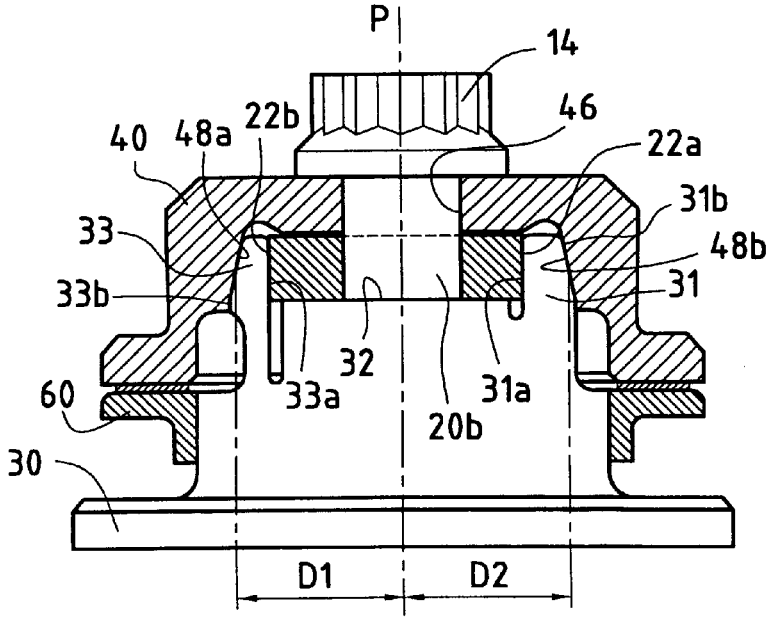
FIG. 5 is a section view on plane V—V of FIG. 4.

In a second embodiment of the invention as shown in FIGS. 4 and 5, the vane pivot 30 of the control device further comprises, compared with the first embodiment described above, a flexible lateral tongue 33 projecting longitudinally from the top face 32 of the pivot 30 and disposed substantially symmetrically to the rigid portion 31 about the longitudinal midplane P of the link. This flexible tongue 33 is made integrally with the pivot 30 and has an inside face 33*a* substantially parallel to the plane P and an outside face 33*b* inclined relative to the plane P.

The second end 20*b* of the link 20 bears against the top face 32 of the pivot 30. The first side face 22*a* of the end 20*b* of the link is parallel to the plane P and bears against the inside face 31*a* of the rigid portion 31, and the second side face 22*b* of the same end 20*b* is likewise parallel to the plane P and bears against the inside face 33*a* of the flexible tongue 33.

The screw 14 is inserted successively through the orifice 46 of the clamping cap, through the orifice 21 in the second end of the link, and into the orifice formed in the vane pivot. If a screw-and-nut system is used, then the threaded rod secured to the vane pivot passes likewise through the orifice 21 in the second end of the link and through the orifice 46 in the clamping cap. As in the preceding embodiment, the cap 40 presents a transverse passage 48 formed in the cylindrical portion 42 of the cap and having two inclined side faces 48*a* and 48*b* which present inclinations corresponding to the inclinations of the faces 33*b* and 31*b*, and which bear against them.

Under the effect of the axial clamping generated by the screw 14 (or by a nut when a threaded rod is used) and under the effect of the resulting bearing force on the inclined faces 33*b* and 31*b*, transverse pinching is exerted serving to press the faces 31*a* & 22*a* and 33*a* & 22*b* against each other in respective pairs. The clamping cap 40 bears against the rigid portion 31 of the vane pivot in order to exert an indirect pinching force on the second end 20*b* of the link 20 via the flexible tongue 33. This eliminates any risk of slack and the link 20 is indeed locked in rotation on the pivot 30 of the vane.

In the example shown in FIGS. 4 and 5, the inclined outside face 33*b* of the flexible tongue 33 and the inclined side face 48*a* of the passage 48 in the clamping cap 40 are shown as being plane. Naturally, it is also possible for these two faces to be substantially conical. Similarly, the outside face 31*b* of the rigid portion 31 and the inclined side face 48*b* of the passage 48 in the clamping cap 40 may also be substantially conical.

Figure 6:
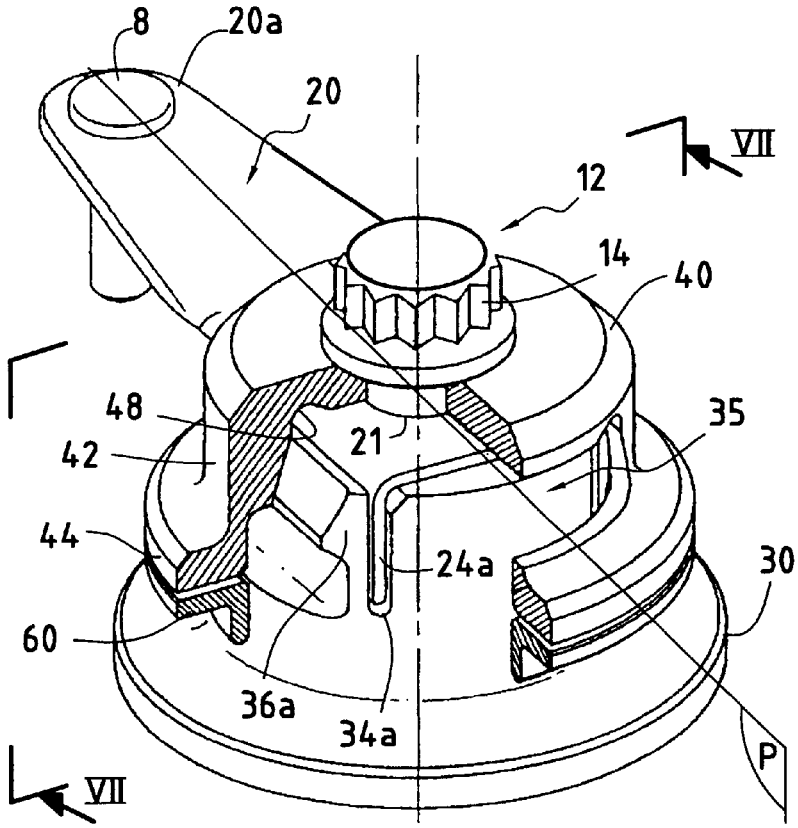
FIG. 6 is a cutaway perspective view of a third embodiment of a control device of the invention.
Figure 7:
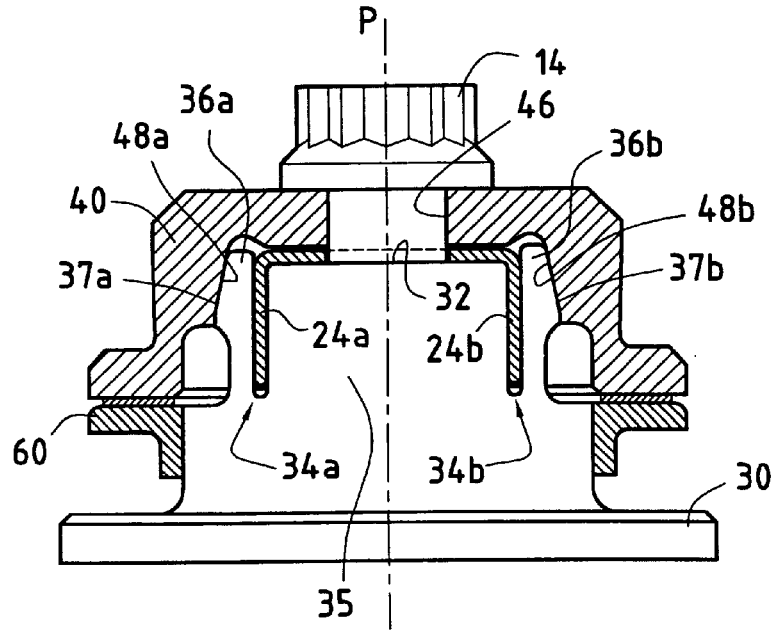
FIG. 7 is a section view on plane VII—VII of FIG. 6.

Reference is now made to FIGS. 6 and 7 which show a third embodiment of the invention. In this embodiment, the vane pivot 30 of the control device has two slots 34*a* and 34*b* that are substantially parallel to the plane P and that are formed between a central block 35 of the pivot 30 and two thin side portions 36*a* and 36*b* forming flexible tongues. Each of these thin side portions has a respective outside face 37*a* or 37*b* which is inclined relative to the longitudinal midplane P of the link.

The second 20*b* of the link 20 bears against the top face 32 of the central block 35 of the pivot 30. This end 20*b* is of channel section having two flanges 24*a* and 24*b* engaged in the slots 34*a* and 34*b* respectively of the vane pivot 30.

The screw 14 is inserted successively through the orifice 46 of the clamping cap, through the orifice 21 in the second end of the link, and into the orifice formed in the vane pivot. When a screw-and-nut system is used, the threaded rod secured to the vane pivot passes likewise through the orifice 21 in the second end of the link and the orifice 46 in the clamping cap. The two inclined side faces 48*a* and 48*b* of the passage 48 formed in the cylindrical portion 42 of the cap present inclinations that correspond to the inclinations of the inclined outside faces 37*a* and 37*b* of the flexible tongues 36*a* and 36*b*, and they bear against them.

Under the clamping effect generated by the screw 14 (or by a nut when a threaded rod is used), the inclined side faces 48*a* and 48*b* of the cap 40 bear against the inclined side faces 37*a* and 37*b* of the flexible tongues so as to obtain a transverse pinching effect on the flanges 24*a* and 24*b* of the second end 20*b* of the link in the slots 34*a* and 34*b* of the vane pivot. Use is thus made of the flexibility of the flexible tongues 36*a* and 36*b* to enable the clamping cap to exert a pinching force indirectly on the second end 20*b* of the link 20. The inclined side faces 37*a* and 37*b* of the flexible tongues enable this clamping force generated by the fixing means 12 to be transmitted symmetrically relative to the plane P. The link 20 is thus locked in rotation without clearance on the vane pivot 30.

Figure 8:
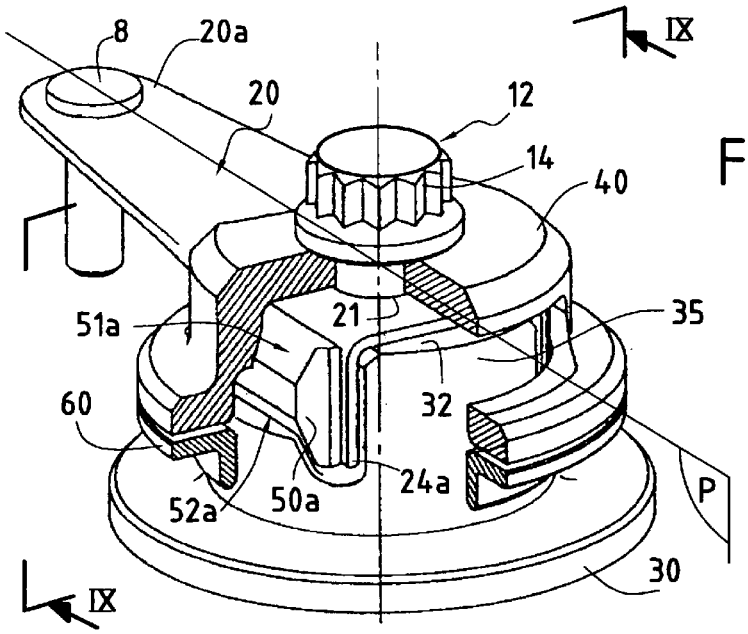
FIG. 8 is a cutaway perspective view of a control device constituting a fourth embodiment of the invention.
Figure 9A:
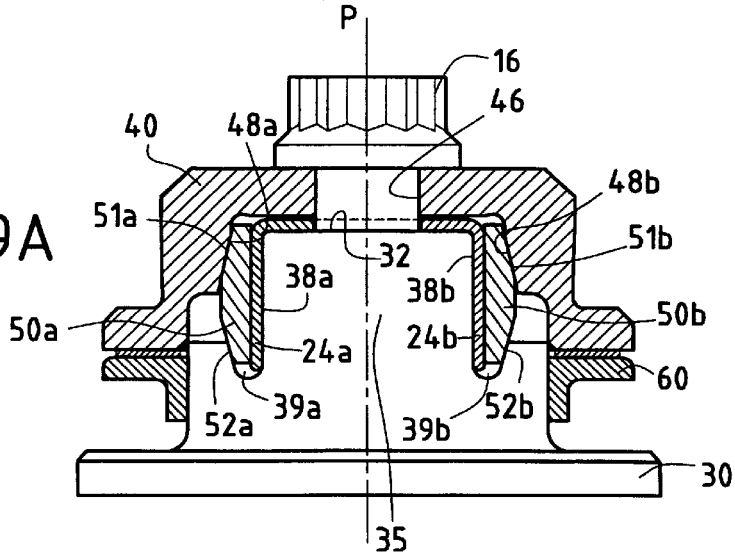
FIGS. 9A and 9B are section views on plane IX—IX of FIG. 8 showing two different variant embodiments.
Figure 9B:
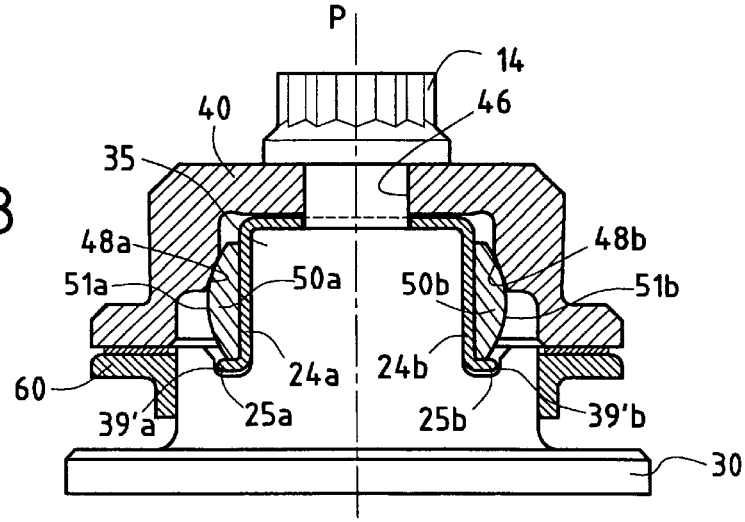

In a fourth embodiment of the invention as shown in FIGS. 8, 9A, and 9B, the vane pivot 30 of the control device presents a block 35 having two plane side faces 38*a* and 38*b* which are substantially parallel to the plane P and symmetrical about said plane P.

The second end 20*b* of the link 20 bears against the top face 32 of the block 35. This end 20*b* is of channel section having two flanges 24*a* and 24*b* which bear against the corresponding plane side faces 38*a* and 38*b* of the vane pivot 30.

Pieces of shim 50*a* and 50*b* are interposed between the inclined side faces 48*a* and 48*b* of the transverse passage 48 formed in the cylindrical portion 42 of the clamping cap 40 and the flanges 24*a* and 24*b* at the second end 20*b* of the link. The top portions of these pieces of shim 50*a* and 50*b* have first outside faces 51*a* and 51*b* that are inclined relative to the plane P.

The screw 14 is inserted successively through the orifice 46 of the clamping cap, through the orifice 21 in the second end of the link, and into the orifice formed in the vane pivot. If a screw-and-nut system is used, then the threaded rod secured to the vane pivot passes likewise through the orifice 21 in the second end of the link and the orifice 46 in the clamping cap. The two inclined side faces 48*a* and 48*b* of the passage 48 formed in the cylindrical portion 42 of the cap present inclinations corresponding to the inclinations of the first inclined outside faces 51*a* and 51*b* of the pieces of shim 50*a* and 50*b* and they bear thereagainst.

Under the axial clamping force generated by the screws 14 (or by a nut when a threaded rod is used), a transverse pinching force is exerted on the flanges 24*a* and 24*b* at the second end 20*b* of the link pressing them against the plane side faces 38*a* and 38*b* of the pivot 30 under bearing thrust from the inclined side faces 48*a* and 48*b* of the cap 40 against the pieces of shim 50*a* and 50*b*. The clamping cap 40 thus exerts a pinching force indirectly on the second end 20*b* of the link 20, by bearing against the first outside faces 51*a* and 51*b* of the pieces of shim. The link 20 is thus locked in rotation without slack on the vane pivot 30.

As shown in FIG. 9A, the pieces of shim 50*a* and 50*b* may advantageously have second outside faces 52*a* and 52*b* in their bottom portions which bear against corresponding faces of the vane pivot 30. These second outside faces 52*a* and 52*b* are preferably inclined relative to the plane P presenting inclinations at angles that are opposite to the angles of inclination of the first inclined outside faces 51*a* and 51*b*, for example being symmetrical thereto about a mid transverse plane of the pieces of shim 50*a* and 50*b*. The inclined side faces 52*a* and 52*b* bear against corresponding inclined faces formed in grooves 39*a* and 39*b* on either side of the central block 35 of the pivot. As a result, the pieces of shim 50*a* and 50*b* which transmit the pinching force exerted by the clamping cap are maintained in a direction that is substantially normal to the plane side faces 38*a* and 38*b* of the vane pivot and at a level which is determined by the design of the pieces of shim 50*a* and 50*b* (the angles of their inclined faces, the positions selected for them in the assembly, . . . ).

In a variant of this fourth embodiment, as shown in FIG. 9B, the first outside face 51*a*, 51*b* of each of the two pieces of shim 50*a*, 50*b* is of substantially curvilinear section. In addition, the flanges 24*a* and 24*b* have their tips folded outwards so as to form rims 25*a* and 25*b* that are received in grooves 39'*a* and 39'*b* on either side of the central block 35 of the pivot. This disposition contributes to holding the link 20 on the pivot 30 without slack.

Figure 10:
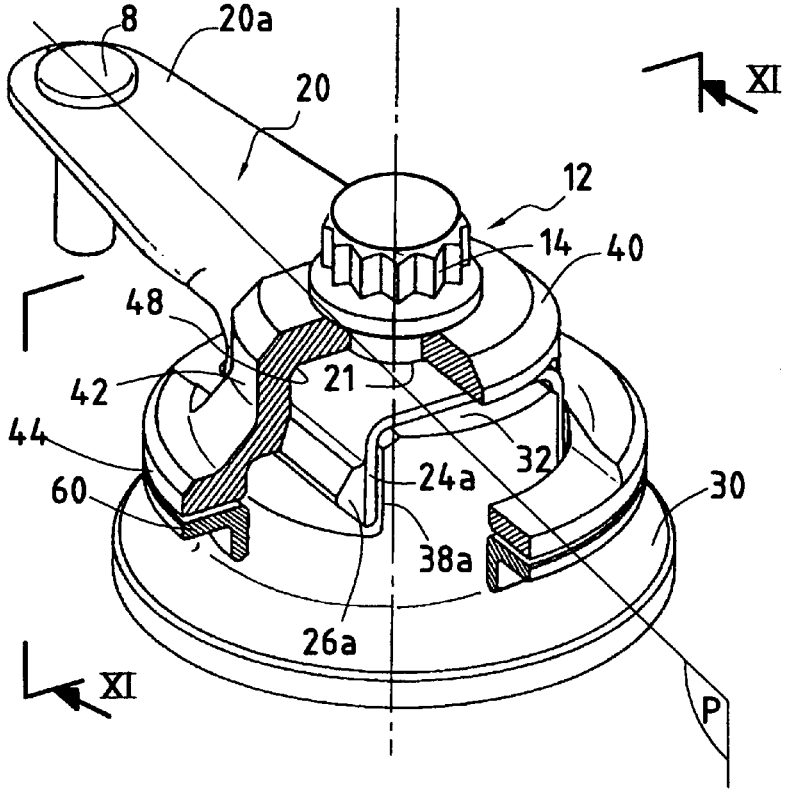
FIG. 10 is a cutaway perspective view of a fifth embodiment of a control device of the invention.
Figure 11:
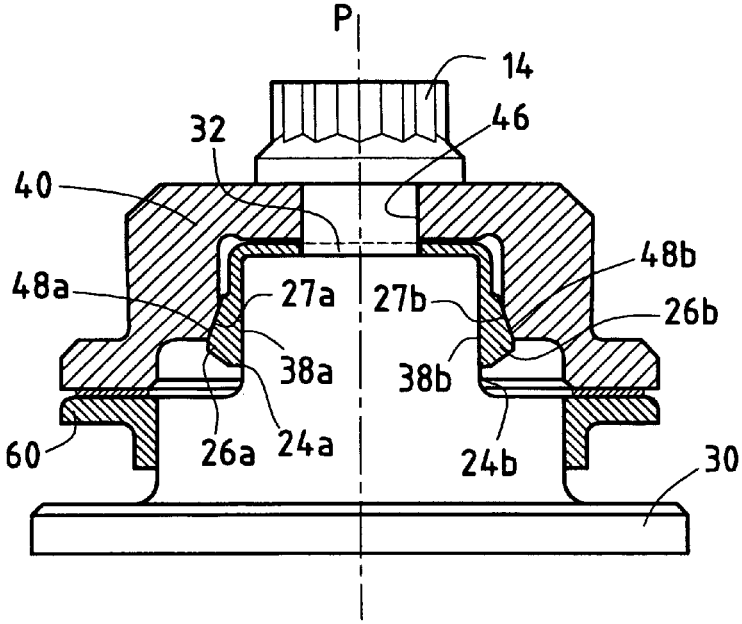
FIG. 11 is a section view on plane XI—XI of FIG. 10.

In a fifth embodiment of the invention as shown in FIGS. 10 and 11, the vane pivot 30 of the control device likewise presents a central block 35 with two plane side faces 38*a* and 38*b* that are substantially parallel to the plane P and that are disposed symmetrically about said plane P.

The second end 20*b* of the link 20 bears against the top face 32 of the block 35 of the pivot 30. This end 20*b* is of channel section having two flanges 24*a* and 24*b* which bear against the plane side faces 38*a* and 38*b*. Splines 26*a* and 26*b* are integrally formed with the flanges 24*a* and 24*b* on the outside faces thereof. These splines 26*a* and 26*b* have outside faces 27*a* and 27*b* that are inclined relative to the plane P.

The screw 14 is inserted in succession through the orifice 46 in the clamping cap, through the orifice 21 in the second end of the link, and into the orifice formed in the vane pivot. When a screw-and-nut system is used, the threaded rod secured to the vane pivot passes likewise through the orifice 21 in the second end of the link and the orifice 26 in the clamping cap. The inclined side faces 48*a* and 48*b* of the passage 48 formed in the cap 40 have inclinations corresponding to the inclinations of the outside faces 27*a* and 27*b* of the splines 26*a* and 26*b*.

Under the effect of the axial clamping generated by the screw 14 (or by a nut when a threaded rod is used), a transverse pinching force is exerted on the flanges 24*a* and 24*b* of the second end 20*b* of the link pressing them against the plane side faces 38*a* and 38*b* of the pivot 30 under thrust from the inclined side faces 48*a* and 48*b* of the clamping cap 40 against the side faces 27*a* and 27*b* of the splines 26*a* and 26*b*. The clamping cap 40 thus exerts a pinching force directly on the second end 20*b* of the link 20 by bearing against the outside faces of the splines 26*a* and 26*b*. The second end 20*b* of the link 20 is thus locked in rotation without slack on the vane pivot 30.

In FIGS. 1 to 11, the clamping cap 40 presents a portion 42 that is substantially cylindrical. In a variant, this cylindrical portion may be replaced, for example, by a portion that is substantially rectangular, in which case the pinch means act in identical manner.

Various other characteristics common to the five embodiments of the control device of the invention are described below.

As shown in FIG. 1, the control device may include a bushing 60 placed around the vane pivot 30 between the clamping cap 40 and the lip 62 of an opening in the casing 6 of the turbomachine in which the pivot 30 of the vane 2 is mounted. This bushing 60 serves to center the vane pivot in the opening in the casing. Under such circumstances, the clamping cap 40 also bears via its periphery against the bushing 60. A piece of shim 64 is then advantageously interposed between the clamping cap 40 and the bushing 60 in order to take up any axial clearance that might exist between these parts. In addition, an antifriction washer 66 may be placed between the lip 62 of the opening in the casing 6 and the base of the vane pivot 30.

It is also known that in the event of large aerodynamic forces acting on vanes of variable setting angle, the length of the control link may need to be longer than the usual standards. It is then appropriate to provide for adjustment of the axial clearance (e.g. of about 0.10 millimeters (mm)) between the top surface of the second end 20*b* of the link 20 against which the clamping cap 40 bears, and the clamping cap. In the second, third, and fourth embodiments of the invention as described above, this adjustment can be achieved by interposing an additional part between these two elements to act as a spacer, optionally by means of a spring effect (this part is not shown in the figures). By way of example, the spacer may be made as a circular part. The presence of such a spacer is nevertheless not necessary for the control devices described in the first and second embodiments of the invention.

Finally, according to an advantageous feature of the invention, the positions of the side faces 22*a* and 22*b* or of the flanges 24*a* and 24*b* of the link 20 may be asymmetrical about the midplane P in order to provide a keying effect to distinguish between a leading edge and a trailing edge of the link. As shown for example in FIGS. 3 and 5, positions are said to be asymmetrical when the distance D1 between one of the side faces 22*a* and 22*b* (or the flanges 24*a*, 24*b*) of the link 20 and the midplane P is greater than or less than the distance D2 between the other side face 22*b*, 22*a* (or other flange 24*b*, 24*a*) and the midplane P.

What is claimed is:

1. A device for controlling a variable-angle vane for a stator of a turbomachine compressor, the device comprising a link, connection means forming a hinge between a first end of the link and a control ring, and fixing means for fixing a second end of the link on a pivot of a vane to be controlled, the device further comprising pinch means acting transversely relative to a longitudinal midplane of the link to lock the second end of the link in rotation without slack on the pivot.

2. A device according to claim 1, wherein the pinch means comprise a clamping cap applied against the second end of the link and subjected to an axial clamping force under the effect of fixing means, said clamping cap presenting a radial passage having at least one inside face which is inclined relative to a longitudinal midplane of said passage and which is for co-operating with a corresponding inclined side face of said second end of the link.

3. A device according to claim 2, wherein the clamping cap exerts a transverse pinching force on the corresponding face of the second end of the link via contact elements interposed in the radial passage between the clamping cap and the second end of the link.

4. A device according to claim 3, wherein the radial passage of the clamping cap presents two inclined inside faces that are symmetrical about the longitudinal midplane of the passage.

5. A device according to claim 3, wherein the pivot presents a rigid portion which projects longitudinally from a top face of the pivot on one side thereof, and which has an inside face against which a first side face of the second end of the link bears.

6. A device according to claim 5, wherein an inclined face of the clamping cap bears against a second inclined side face of the second end of the link opposite from the face against which the inside face of the rigid portion bears.

7. A device according to claim 5, wherein the pivot further presents a flexible tongue projecting longitudinally from the top face of the pivot on a side opposite from the side from which the rigid portion projects, the flexible tongue having an inside face which bears against the second side face of the second end of the link opposite from the face against which the inside face of the rigid portion bears, and an inclined outside face against which an inclined side face of the clamping cap bears.

8. A device according to claim 7, wherein the inclined outside face of the flexible tongue and the inclined side face of the clamping cap are plane.

9. A device according to claim 7, wherein the inclined outside face of the flexible tongue and the inclined side face of the clamping cap are substantially conical.

10. A device according to claim 6, wherein the side faces of the second end of the link present positions that are symmetrical about the midplane.

11. A device according to claim 3, wherein:

the vane pivot presents two slots formed between a central block of the pivot, and two thin lateral portions forming flexible tongues having outside faces that are inclined relative to the longitudinal midplane of the link;

the second end of the link is of channel section with two flanges engaged in the slots of the pivot; and the inclined side faces of the clamping cap bear against the inclined side faces of the flexible tongues under the effect of the fixing means so as to generate a transverse pinching force on the flanges of the second end of the link in the slots of the vane pivot.

12. A device according to claim 3, wherein:

the second end of the link is of channel section with two flanges bearing against plane side faces of a central block of the vane pivot;

pieces of shim are interposed between the inclined side faces of the clamping cap and the flanges of the second end of the link; and the inclined side faces of the clamping cap bear against first outside faces of corresponding inclination of the pieces of shim under the effect of the fixing means to generate a transverse pinching force on the flanges of the second end of the link against the plane side faces of the vane pivot.

13. A device according to claim 12, wherein the pieces of shim have second inclined outside faces of inclinations opposite to the inclinations of their first outside faces and bearing against corresponding faces of the vane pivot.

14. A device according to claim 12, wherein the outside face of each of the two pieces of shim is of substantially curvilinear section.

15. A device according to claim 11, wherein the flanges of the second end of the link present positions that are symmetrical about the midplane.

16. A device according to claim 3, wherein:

the second end of the link is of channel section with two flanges bearing against plane lateral faces of a central block of the vane pivot;

both flanges of the second end of the link presents respective external splines; and the inclined side faces of the clamping cap bear against outside faces of corresponding inclination of the splines under the effect of fixing means to generate a transverse pinching force on the flanges of the second end of the link against the plane side faces of the vane pivot.

17. A device according to claim 2, wherein the fixing means comprise a screw passing through a first orifice formed in the second end of the link, a second orifice formed in the clamping cap, and into a third orifice formed in the vane pivot.

18. A device according to claim 2, wherein the fixing means comprise a threaded rod secured to the vane pivot, passing through a first orifice formed in the second end of the link and through a second orifice formed in the clamping cap, and having a clamping nut tightened thereon.

* * * * *